United States Patent [19]

Baugh et al.

[11] 4,372,390

[45] Feb. 8, 1983

[54] WELL VALVE

[75] Inventors: John L. Baugh; James W. Montgomery; Malcolm B. Roach, all of Houston, Tex.

[73] Assignee: Hughes Tool Company, Houston, Tex.

[21] Appl. No.: 183,128

[22] Filed: Sep. 2, 1980

[51] Int. Cl.[3] ..... E21B 23/06; E21B 34/12; E21B/33/12

[52] U.S. Cl. ..... 166/373; 166/128; 166/143; 166/ 166/143; 166/148

[58] Field of Search ..... 166/126–128, 166/148, 143, 146, 147, 152, 144, 142, 332, 334, 238, 373, 386, 387; 285/39, 18, 317

[56] References Cited

U.S. PATENT DOCUMENTS

| | | | |
|---|---|---|---|
| 3,089,546 | 5/1967 | Cochran | 166/332 |
| 3,229,767 | 1/1966 | Carter | 166/134 |
| 3,306,359 | 2/1967 | Edwards | 166/120 |
| 3,356,140 | 12/1967 | Young | 166/332 |
| 3,460,617 | 8/1969 | Brown | 166/124 |
| 3,763,932 | 10/1973 | Dinning | 166/72 |
| 4,049,055 | 9/1977 | Brown | 166/278 |

OTHER PUBLICATIONS

"Composite Catalog" of Oil Well Equipment, pp. 1041, 1054, 1056, 1978–79 edition.

*Primary Examiner*—William F. Pate, III
*Attorney, Agent, or Firm*—Robert A. Felsman; Charles D. Gunter, Jr.

[57] ABSTRACT

Disclosed are apparatus and method of closing a conduit against fluid flow in at least one longitudinal sense, and selectively disengaging and reengaging the closure mechanism without removing the closure mechanism from the conduit. In a particular embodiment, a valve assembly may be selectively anchored and sealed to a well packer, or disengaged therefrom. The valve assembly is manipulated by an operating tool to which the valve assembly is anchored in the well when the valve assembly is disengaged from the packer.

19 Claims, 9 Drawing Figures

FIG. 5B
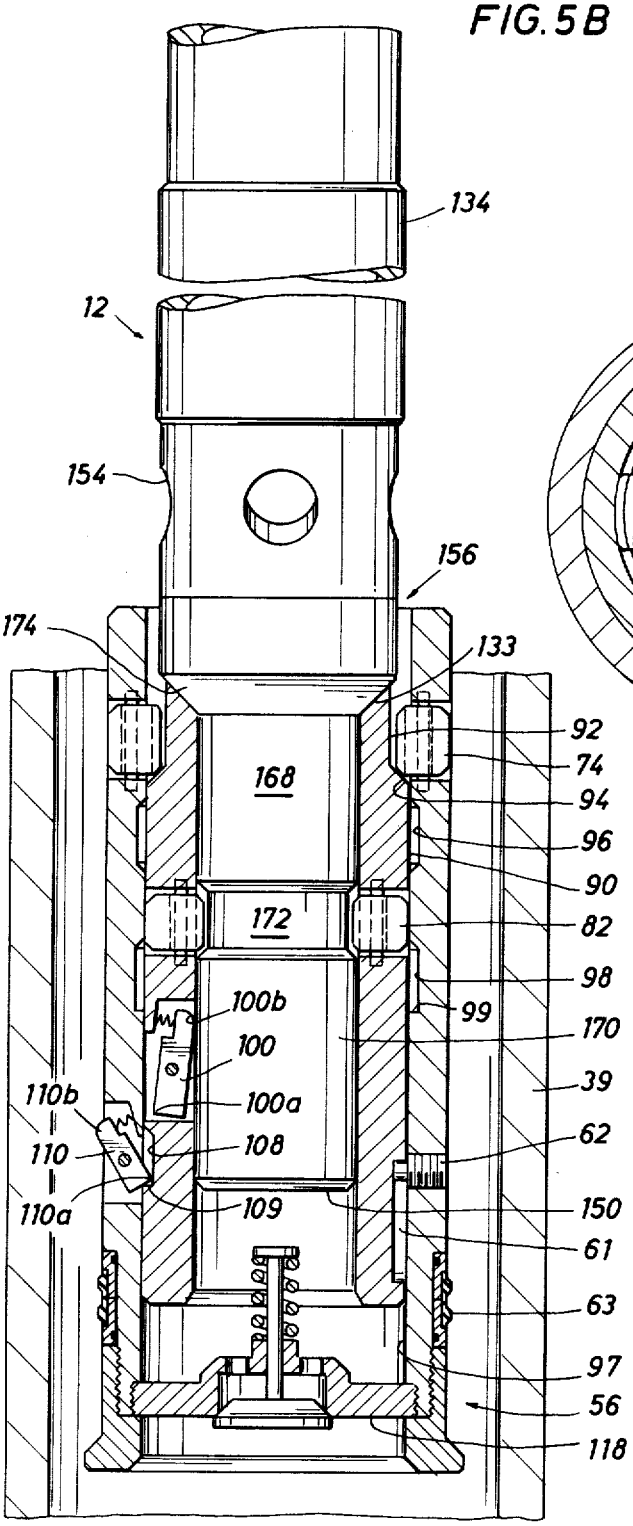
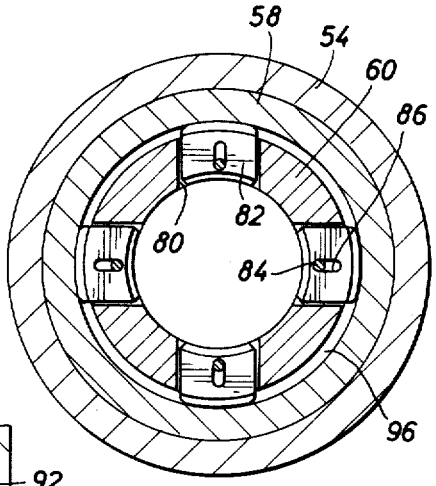
FIG. 6

WELL VALVE

BACKGROUND OF THE INVENTION

1. Field of the Invention

The present invention pertains to downhole well valves. More particularly, the present invention relates to techniques for selectively opening and closing wells at downhole locations.

2. Description of Prior Art

At various times during operations on wells, it is necessary to close the well completely, at least to upward flow of fluid. For example, during squeeze cementing operations a portion of the well is shut off to contain the cementing fluid. Where production must be interrupted, for example, a well under pressure must be plugged, or shut off at the surface.

Bridging plugs are known for use in shutting off wells at downhole locations. Such bridging plugs are lowered into the well, by wireline for example, and latched into place on a structure already in position in the well. When it is desired to open the well again, the bridging plug is retrieved by use of a fishing tool on a wireline, for example. Plugs may also be run in the well on a tubing string, and later retrieved by means of a tubing string. Such operations are time consuming and costly. Additionally, while the plug is being manipulated into or out of the well, the well is not closed, and pressure in the well must be maintained by a sufficient hydrostatic head.

Similarly, when it is necessary to round-trip a tubing string in order to accomplish varied operations in the well, the well must be maintained under sufficient hydrostatic head to prevent a blow-out. For example, if a well is to be tested and then cemented, it may be necessary to round trip the test string before cementing, or to maintain the test string in the well to hold the pressure while waiting on the cement.

It will be appreciated by those in the field that the operation of withdrawing the tubing string from a well and replacing same or another string is expensive. Further, such operations are inherently dangerous, as generally are all well-working operations involving insertion or withdrawal of tubing or other equipment, particularly in high pressure wells.

It is desirable to provide method and apparatus for selectively opening and closing a well at a downhole location without, for example, necessarily withdrawing a production string from the well for that purpose. Additionally, it is desirable to provide means whereby a well may be shut down against upward flow at a downhole location, and wherein a well may be quickly closed off at such a downhole location.

SUMMARY OF THE INVENTION

The present invention provides apparatus for use in a conduit, and including a generally tubular body with an internal passage. A sleeve assembly carries an anchoring mechanism which is selectively operable for cooperation with the tubular body for releasably connecting the sleeve assembly to the tubular body. The sleeve assembly includes a first member and a second member selectively movable relative to the first member to so operate the anchoring mechanism.

The sleeve assembly carries a valve mechanism for at least selectively and partially closing the internal passage of the tubular body against fluid flow therethrough, at least in one longitudinal direction sense.

When the sleeve assembly is so releasably connected to the tubular body by the anchoring mechanism, the sleeve assembly is also sealed to the tubular body to cooperate with the valve mechanism to so restrict flow through the tubular body internal passage.

Operating means are provided for selectively manipulating the sleeve assembly. The operating means may engage the sleeve assembly, and operate the sleeve assembly to release both the anchoring and sealing engagement to the tubular body, while effecting anchoring of the sleeve assembly to the operating means. With the sleeve assembly so mounted on the operating means, the sleeve assembly may be manipulated to permit fluid flow through the central passage of the tubular body.

The operating means may also manipulate the sleeve assembly to again at least partially block the tubular body passage against fluid flow. The operating means may reposition the sleeve assembly relative to the tubular body, effecting both anchoring and sealing engagement between the sleeve assembly and the tubular body. With the sleeve assembly so connected to the tubular body, the sleeve assembly is released from anchoring engagement with the operating means.

In a particular embodiment illustrated, a well packer is provided with a valve assembly releasably connectible to the anchoring and sealing devices of the packer, wherein the valve assembly at least partially closes the central passage through the packer to fluid flow in one direction. An operating tool is provided for selectively manipulating the valve assembly to engage or disengage the valve assembly relative to the packer, disengagement of the valve assembly from the packer permitting fluid flow in both directions through the central passage of the packer. The operating tool causes the valve assembly to be engaged therewith upon disengagement of the valve assembly from the packer.

In a method of the invention, a packer, including a releasably attached valve, may be set in a well wherein the central passage through the packer is closed against at least fluid flow in one longitudinal sense. An operating tool, including a transfer tool and a seal assembly, may be manipulated to engage the valve with the transfer tool. The valve may be disengaged from the packer and manuvered to open the central passage to fluid flow. The operating tool is sealed to the packer to direct the fluid flow through the packer through a flow path within the operating tool. The operating tool may be manipulated to reconnect the valve to the packer to close off the central passage against fluid flow in at least one longitudinal sense, disengaging the operating tool from the valve.

The present invention provides method and apparatus for selectively opening and blocking a well to selectively prevent fluid flow therethrough in at least one longitudinal sense without the necessity of completely removing a valve mechanism, by a pipe string or wireline, for example, from the well to so open the well conduit. The operating string used to manipulate the valve mechanism according to the present invention may remain within the well conduit whether the well is open or blocked to fluid flow by the valve device.

BRIEF DESCRIPTION OF THE DRAWINGS

FIGS. 5A and 5B combined are views similar to FIG. 4, but illustrating the valve assembly displaced from engagement with the packer by the operating tool, FIG. 5A illustrating the upper fragment of the apparatus and FIG. 5B illustrating the lower fragment; and FIG. 6 is a transverse sectional view taken along lines 6—6 of FIG. 1B and illustrating the inner sleeve member anchoring dogs.

BRIEF DESCRIPTION OF THE PREFERRED EMBODIMENTS

Figure 1A:
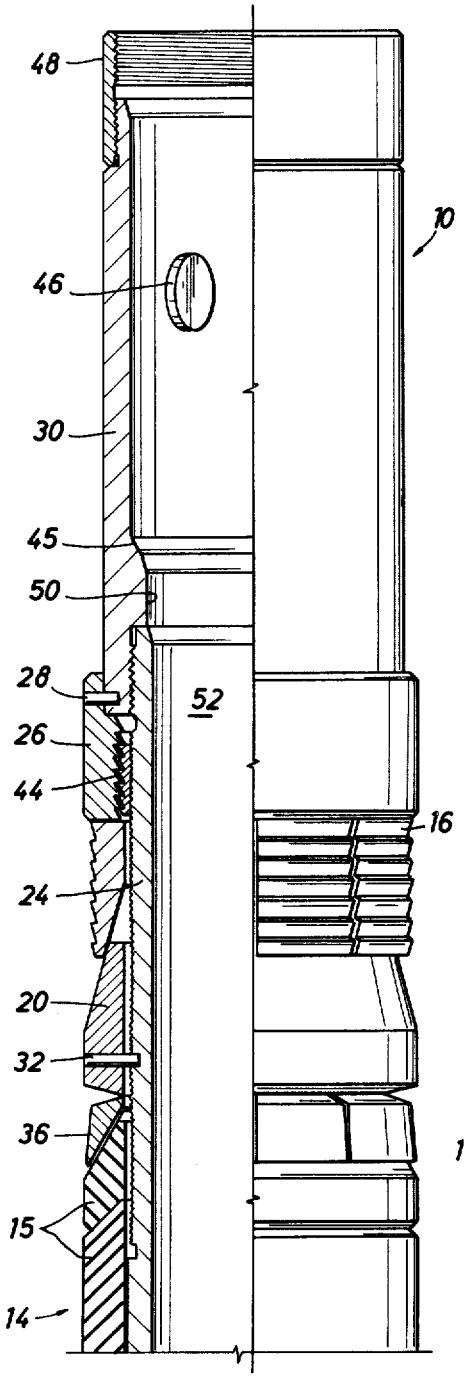
FIGS. 1A and 1B combined illustrate a well packer in quarter section equipped with a valve assembly, according to the present invention, FIG. 1A showing the upper portion of the apparatus and FIG. 1B showing the lower portion.
Figure 1B:
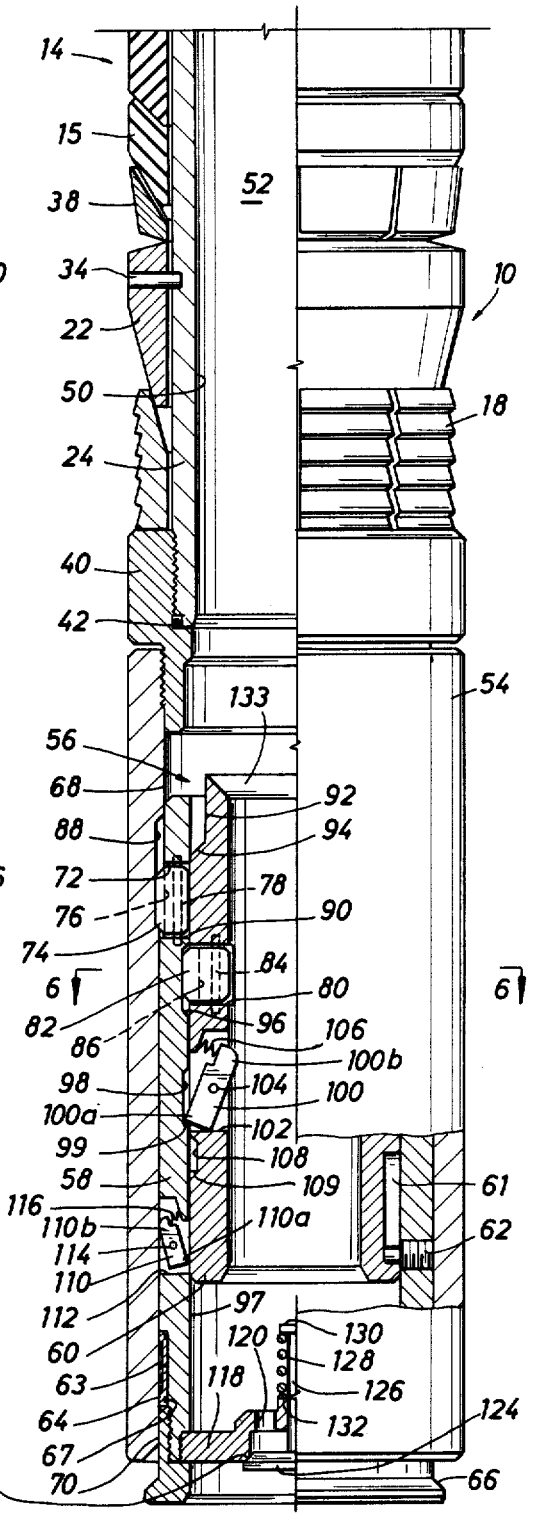
Figure 2A:
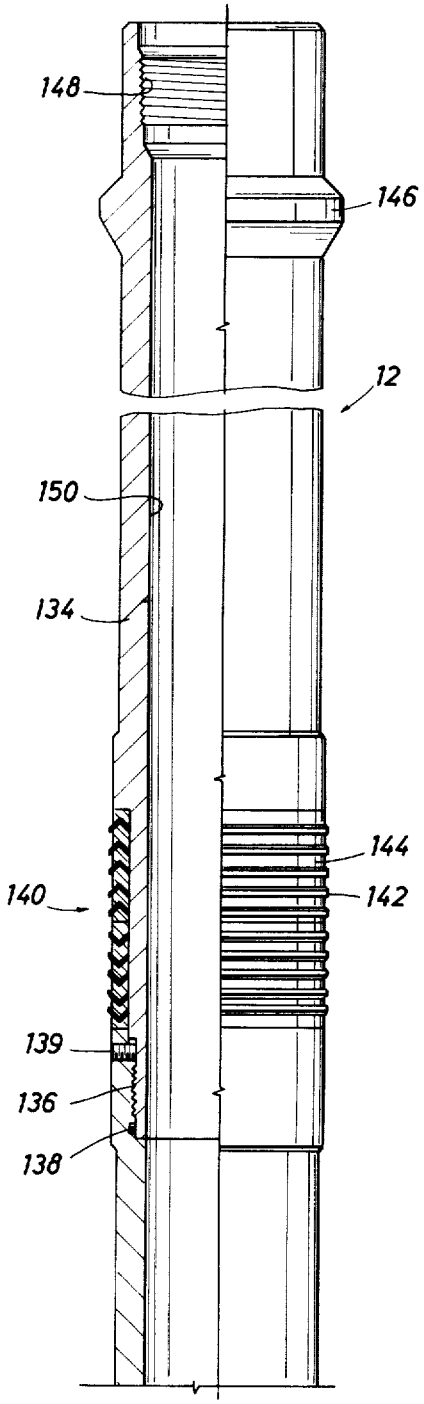
FIGS. 2A and 2B combined illustrate an operating tool according to the present invention in quarter section, FIG. 2A illustrating the upper portion of the tool and FIG. 2B illustrating the lower portion.
Figure 2B:
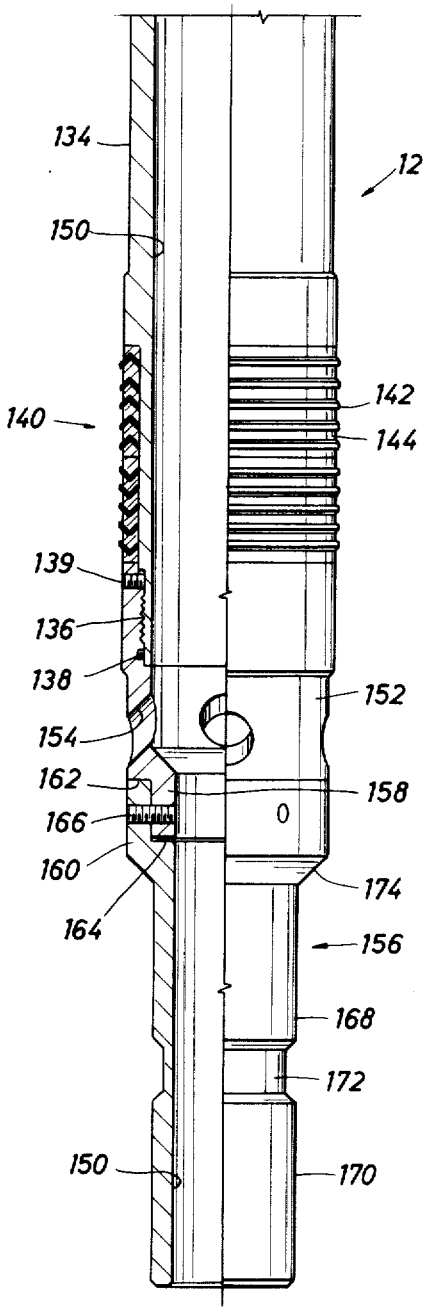

The present invention is illustrated in the form of a well operating apparatus, including a valve-equipped packer shown generally at 10 in FIGS. 1A and 1B, and an operating tool shown generally at 12 in FIGS. 2A and 2B. The packer 10 includes a packer seal assembly shown generally at 14 having resilient annular seal elements 15, and a packer anchoring assembly, including upper and lower frangible slip collars 16 and 18, respectively. The slip collars 16 and 18 are designed to break into separate slip members upon being wedged onto upper and lower cones 20 and 22, respectively, during the setting of the packer 10.

Figure 3:
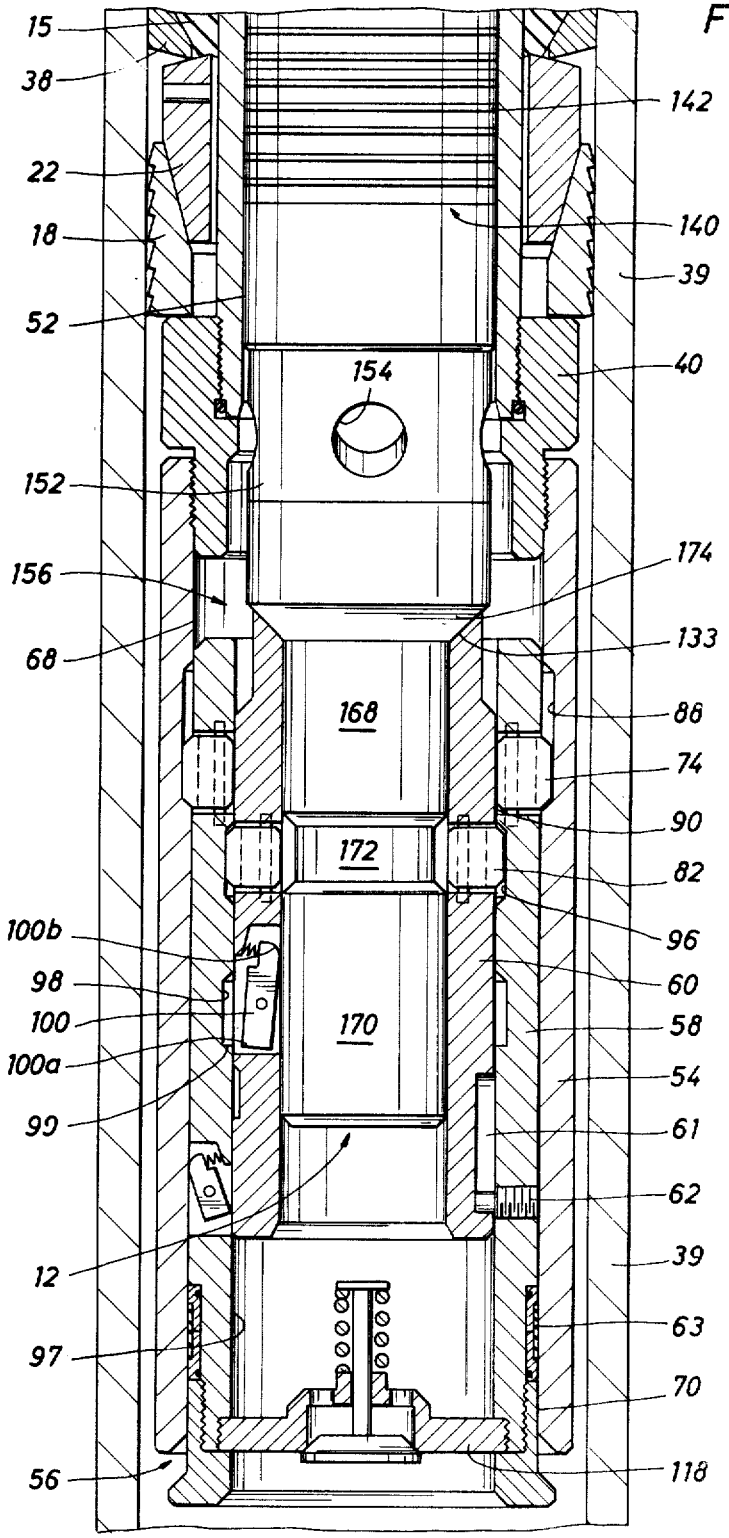
FIG. 3 is an enlarged view in partial section of the lower portion of the operating tool engaged with the lower portion of the packer and valve.

The setting of the packer is achieved by compressing the packer anchoring elements and seal assembly 14 downwardly along an inner packer mandrel 24. Such compression may be effected by driving a setting sleeve (not shown) downwardly on a compression collar 26, breaking one or more shear pins or screws 28 to release the collar from a tie-back sleeve 30 threadedly engaged to the top of the mandrel 24. Similarly, shear screws or pins 32 and 34 are broken during the setting procedure to release the cones 20 and 22, respectively, for movement downwardly along the mandrel 24, axially compressing the resilient seal elements 15 of the seal assembly 14 between seal retainers 36 and 38 to radially expand the seal elements into sealing engagement with a surrounding well conduit 39 (FIG. 3). Such a well conduit 39 may be provided by casing or liner cemented in the well. The individual slip member of the collars 16 and 18 are wedged by the cones 20 and 22, respectively, into gripping engagement with the conduit 39 to anchor the packer 10 against upward and downward movement relative to the conduit. The packer 10 is thus sealed to the conduit 39 against fluid pressure in either longitudinal sense. The downward compression of the packer elements during setting is effected against a collar 40, threadedly engaged with, and sealed by an O-ring seal 42 to, the packer mandrel 24. A locking ring 44 is driven downwardly with the compression collar 26 to threadedly engage buttress threads on the outer surface of the mandrel 24, thereby locking the packer 10 in set configuration, sealed and anchored to the surrounding well conduit 39 (FIG. 3).

An upwardly-facing frustoconical surface 45 marks a change in internal diameter of the tie-back sleeve 30, and may serve a purpose as discussed hereinafter.

The packer 10 may be of any type which may be sealed and anchored within a well conduit. For example, a packer such as that illustrated at 10 may be lowered into a well conduit, supported by a jay-pin 46, and set by means of a setting sleeve as described, the setting sleeve being releasably connected to the packer by means of a collar 48. The setting sleeve may be mechanically or hydraulically operable. U.S. Pat. No. 3,306,359, incorporated herein by reference, discloses a hydraulically-operable wireline setting tool in conjunction with a packer, either or both of which may be employed according to the present invention. U.S. Pat. Nos. 3,229,767, 3,460,617 and 4,049,055, all of which are also incorporated herein by reference, also disclose setting tools and/or packers generally compatible with the construction and operation of the present invention. A packer which is effective in maintaining sealing engagement with the well conduit against a pressure differential in either longitudinal sense may be preferred for various applications. The packer 10 is shown for purposes of illustration rather than limitation. It will be appreciated that packers of this type, for example, as well as their function and operation are known, and need not be further described herein.

A packer used with the present invention may include a central passage 50, passing along the interior of the packer mandrel 24 whose inner surface may be sufficiently smooth to serve as a seating surface sealing element 52.

The packer 10 continues downwardly in the form of a generally tubular body 54, threadedly connected to the collar 40. The collar 40 and the packer mandrel 24 form an upward extension of the tubular body 54, the central passage 50 extending downwardly through the collar and the tubular body.

In the configuration of FIG. 1B, the tubular body 54 supports a valve assembly shown generally at 56, in the form of a sleeve assembly carrying a closure device for sealing off the central passage 50.

The valve assembly 56 includes a first, or outer, generally tubular sleeve member 58, which may be positioned within the tubular body 54, and a second, or inner, generally tubular sleeve member 60 positioned within the first sleeve member.

A stop device defines the limits of relative longitudinal movement between the first and second sleeve members. The second sleeve member 60 features a longitudinally-extending slot 61 in the outer surface of the sleeve member, which receives a pin 62 extending through, and threadedly engaged with, a threaded bore in the wall of the first sleeve member 58. The pin 62 is thus confined within the slot 61, and cooperates with the slot to limit the longitudinal movement of the second sleeve member 60 relative to the first sleeve member 58 between a first position, as illustrated in FIGS. 1B and 3 in which the pin is located toward the bottom of the slot, and a second position, illustrated in FIGS. 4 and 5B in which the second sleeve member is lower relative to the first sleeve member than in the first position, and wherein the pin is located toward the top of the slot. The operation and function of the two sleeve members 58 and 60 in moving between these relative longitudinal positions are discussed in further detail hereafter.

In the configuration of FIG. 1B, the valve assembly 56 is anchored and sealed to the tubular member 54. The first sleeve member 58 carries a seal assembly including a pair of annular resilient seal members 63 which are mounted on a pair of seal retainer rings 64 set in an appropriate external annular recess in the first sleeve member, and held in place by a flanged ring 66 threadedly engaged to the bottom of the sleeve member. A pair of O-ring seals 67 provide sealing engagement between the seal retainers 64 and the body of the first sleeve member 58. With the first sleeve member 58 positioned within the tubular body 54 as illustrated in FIG. 1B, the resilient seal members 63 provide sealing engagement between the valve assembly 56 and the internal surface 68 of the tubular body 54 acting as a seating surface. Additionally, the external cylindrical surface of the ring 66 cooperates with the lower portion of the internal annular surface 68 of the tubular body 54 to provide a metal-to-metal sealing engagement between the tubular body and the valve assembly 56 at 70. These sealing engagements are established, for example, by sliding the first sleeve member 58 longitudinally into the tubular body 54, the tight fit of these two elements ensuring both types of sealing engagements.

The first sleeve member includes four circumferentially spaced apertures 72 in which are mounted a like number of anchoring members, or dogs, 74. Each of the dogs 74 features a radially oriented slot 76 extending the length of the dog. A spring-loaded pin, for example, 78 is confined within each slot 76 and anchored within appropriate bores in the wall of the first sleeve member 58 to serve as a stop to limit the movement of the latch member 74 relative to the sleeve member. Each dog 74 is thus movable in its aperture 72 radially between an extended position and a retracted one, as defined by the radial extent of the slot 76 confining the pin 78.

The second sleeve member 60 similarly includes four circumferentially spaced apertures 80, with an anchoring member, or dog, 82 mounted in each aperture and generally constrained to radial movement by a spring-loaded pin, for example, 84 residing in an anchoring member slot 86 and set in appropriate bores in the second sleeve member wall (FIG. 6). Each dog 82 is then movable in its aperture 80 radially between an extended position and a retracted one, as defined by the radial extent of the slot 86 confining the pin 84.

While four first anchoring members 74 and four second anchoring members 82 are indicated and described herein, it will be appreciated that any other number of such anchoring members may be utilized as appropriate.

The first anchoring members 74 are received within an internal annular groove 88 about the interior surface of the tubular body 54. The longitudinal extent of the groove 88 may be enlarged sufficiently to ensure that the metal-to-metal seal 70 between the first sleeve member 58 and the tubular body 54 may be properly engaged as the sleeve member is positioned longitudinally relative to the tubular body.

The external, generally cylindrical surface of the second sleeve member includes a first surface region 90 and a second external annular surface region 92 axially spaced upwardly from the first surface region 90, and of lesser outer diameter than the first surface region. An annular frustoconical surface region 94 separates the two cylindrical surface regions 90 and 92.

Figure 4:
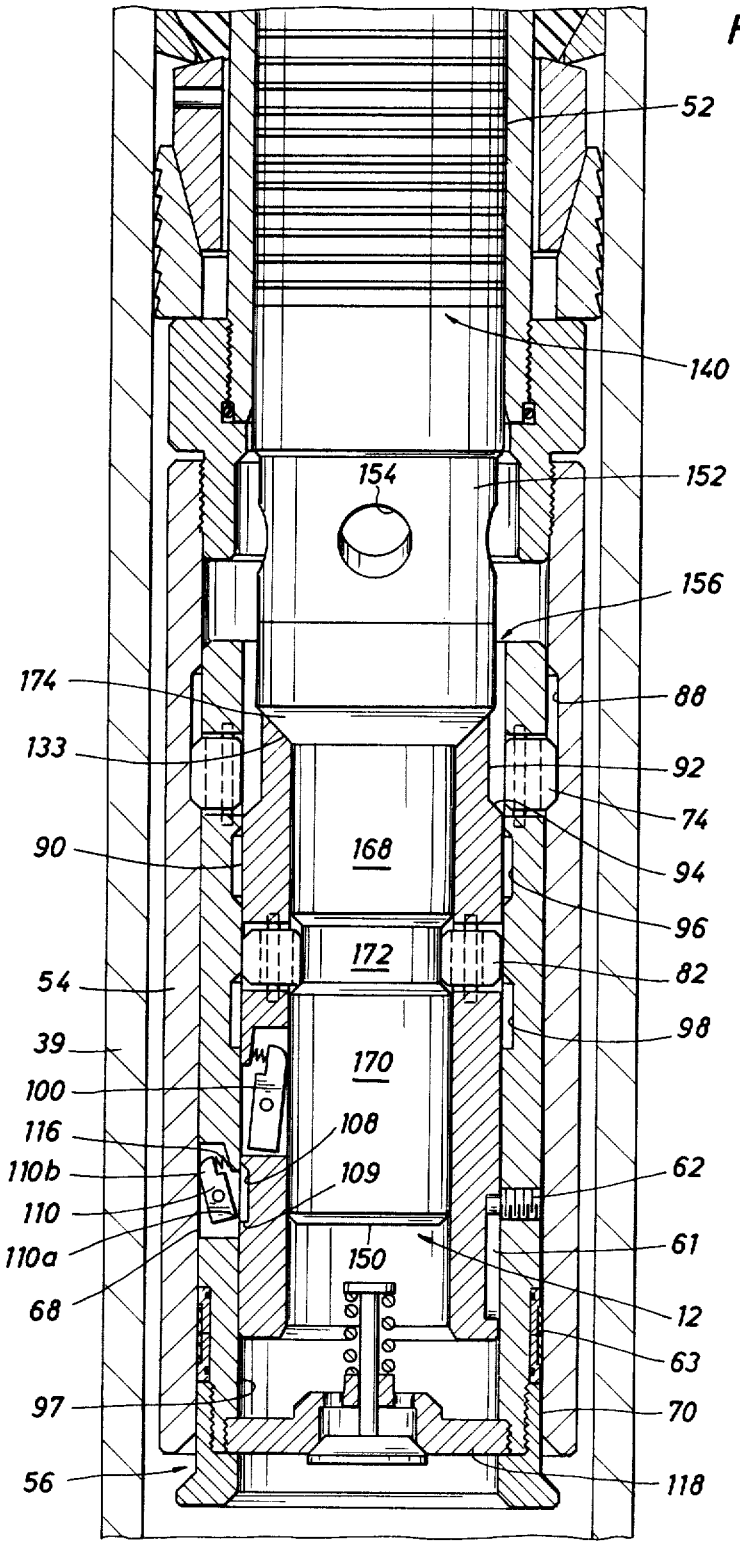
FIG. 4 is an illustration similar to FIG. 3, but showing the valve assembly unlocked from its anchoring connection with the packer.

With the second sleeve member 60 in the first position as shown in FIGS. 1B and 3, the first surface region is in registration with the first dogs 74, and is of such outer extent as to engage the dogs and maintain them locked in extended configuration within the tubular body groove 88. In the second longitudinal position illustrated in FIGS. 4 and 5B, the second sleeve member 60 locates the second surface region 92 in registration with the first anchoring members 74, allowing the dogs to move to the retracted configuration and withdraw from the tubular body groove 88 (FIG. 4).

The first sleeve member features an internal annular groove 96 within the inner surface of the sleeve member. With the second sleeve member 60 in the first longitudinal position, the second anchoring members 82 are in registration with, and may reside in, the first sleeve member groove 96. With the second sleeve member 60 in the second longitudinal position, the second dogs 82 are out of registration with the groove 96 and are abutted by the interior surface 97 of the first sleeve member 58, and held thereby in radially retracted configuration (FIGS. 4 and 5B).

With the sleeve members 58 and 60 in the first longitudinal position, a second internal annular groove 98 in the inner surface of the first sleeve member 58 is in registration with a spring-loaded latch 100 mounted in an appropriate slot 102 through the wall of the second sleeve member 60. The latch 100 is pivoted on a pin 104, for example, fastened in the sleeve member wall, and is urged in the clockwise rotational sense, as viewed in FIG. 1B, by a spring 106 to extend a lower latching corner **100*a* into the first sleeve member groove 98. As illustrated in FIG. 1B, the lower limit of the first sleeve member groove 98 is defined by a shoulder 99 oriented perpendicularly to the longitudinal axis of the first sleeve member 58, while the upper extent of the groove 98 features a beveled surface, as do the grooves 88 and 96. Such beveled surfaces facilitate movement of the corresponding anchoring and latch members out of the grooves at those surfaces as does the frustoconical surface 94, while the right-angle definition of the shoulder 99 receives the latch edge 100*a* to hold the latch 100 in the groove 98. Consequently, the latch 100 as so received within the groove 98, as illustrated in FIG. 1B, prevents downward longitudinal movement of the second sleeve member 60 relative to the first sleeve member 58**, and so locks the second sleeve member in the first longitudinal position.

A curved camming surface **100*b* is provided as part of the latch member 100, positioned opposite to the latching edge 100*a*, for use in releasing the latch from the grove 98**, as described hereinafter.

The second sleeve member 60 features an external, inwardly-directed annular groove, or slot, 108, with its upper limit defined by a slanted surface and its lower extent defined by a shoulder 109 oriented perpendicularly to the longitudinal axis of the second sleeve member, in the same fashion as the definition of the first sleeve member groove 98. As described hereinafter, with the sleeve members 58 and 60 in the second position, the groove 108 is in registration with and may receive a spring-loaded latch member 110 carried in an appropriate slot 112 in the wall of the first sleeve member 58 (FIGS. 4 and 5B). The latch member 110 is pivoted about a pin 114, for example, fastened in the wall of the sleeve member, and is urged in a counter-clockwise rotational sense, as viewed in FIG. 1B, by a compressed spring 116.

The latch member features a latching edge **110*a*, which may be so received within the groove 108 as discussed hereinafter (FIG. 5B), and an oppositely-positioned curved camming surface 110*b*. In the configuration of FIG. 1B, the latch member 110 is constrained against counter-clockwise rotation by the internal surface 68 of the tubular body 54 engaging the camming surface 110***b*. It is only when the first and second sleeve members are in the second longitudinal position, and are removed from tubular body 54 sufficiently to disengage the camming surface 110*b* from the tubular body surface 68, that the latching edge 110*a* is received within the second sleeve member groove 108. Then, as discussed hereinafter, the first sleeve member 58 is prevented from moving downwardly relative to the second sleeve member (FIG. 5B).

A valve device 118 is threadedly engaged with the bottom of the first sleeve member 58 to close off the central passage of the first sleeve member. The valve mechanism 118 includes one or more passages 120 which may be approached through an annular, frustoconical seating surface 122. A valve element 124 is mounted on a shaft 126 which is urged relatively upwardly by a compressed coil spring 128 acting between a flange 130 at the end of the shaft and a shoulder 132 at the base of the valve mechanism. The spring 128 thus propels the valve element 124 against the seating surface 122, and, in the absence of forces overcoming the restorative forces of the spring to move the valve element relatively downwardly, maintains the valve element in sealing engagement against the seating surface.

With the valve assembly 56 positioned within the tubular body 54 as illustrated in FIG. 1B, the valve device 118 combines with the sealing elements 63 and 70 to provide closure of the central passage 50 through the tubular body and the packer 10 against fluid flow in the longitudinal upward sense and, in the absence of sufficient hydraulic or other forces, against fluid flow in the longitudinal downward sense.

The inner diameter of the second sleeve member 60 is sufficiently large to permit the second sleeve member to partially enclose the valve device 122 when the sleeve members are in the second longitudinal position (FIGS. 4 and 5B). The top of the second sleeve member ends in an internal frustoconical surface 133 for a purpose discussed hereinafter.

Construction of the operating tool 12 may be appreciated by reference to FIGS. 2A and 2B. The operating tool 12 is in the form of an elongate tubular assembly that may be constructed using one or more individual members 134 threadedly connected, such as at 136, and mutually sealed by O-ring seals 138 and locked by set screws 139, for example. Positioned along the length of the operating tool 12 is one or more seal assemblies, shown generally at 140, including a plurality of resilient annular seal members 142. As shown, the seal members 142 are of the chevron type, and are mutually spaced by metal spacers 144. The plurality of seal members 142 and spacers 144 is positioned within an appropriate external annular groove at the end of one tubular member 134, with the adjoining tubular member abutting the plurality of seal members and spacers and providing axial compression forces to ensure sufficient radial expansion of the seal members, as discussed further hereinafter.

The upper end of the operating tool 12 features a radially outwardly extending, beveled landing collar 146 for a purpose described hereinafter, and a threaded box 148 for connecting the operating tool to an operating pipe string (not shown), for example.

The interior of the operating tool 12 features a longitudinal flow path 150 extending the length of the tool. Connected to the bottom of the lowest tubular member 134 carrying a seal assembly 140 is a port sub 152, which is also sealed (O-ring 138) and locked (set screw 139) in its threaded engagement 136 to the tubular member. The port sub 152 features four downwardly-slanted ports 154 for communication between the central flow path 150 and the exterior of the operating tool 12.

A transfer tool shown generally at 156 is supported by the port sub 152, and extends downwardly to form the bottom of the operating tool 12.

The bottom of the port sub 152 ends in a tubular shaft 158 which is received within, and meshes with, an annular upset top end 160 of the transfer tool 156, the two elements 158 and 160 establishing abutting surfaces at 162 and 164 whereby the port sub may transmit downward forces to the transfer tool. A plurality of shear screws 166 pass through the walls of the transfer tool upset end 160 and the port sub shaft 158 wherein these two elements intermesh to provide means for the port sub 152 to support and raise the transfer tool 156. The shear screws 166 are selected to break in the event the transfer tool 156 is prevented from being raised within a well, as discussed more fully hereinafter.

Below the union with the port sub 152, the transfer tool 156 extends downwardly in a tubular shank of reduced outer diameter, divided between cylindrical surface regions 168 and 170 mutually axially separated by an annular groove, or profile, 172 of lesser outer diameter. A downwardly-facing frustoconical surface 174 separates the cylindrical surface region 168 from the upset end 160 of the transfer tool 156.

The operating tool 12 may be used to selectively engage the valve assembly 56 by means of the transfer tool 156, while disengaging the valve assembly from the tubular body 54. In this way, the valve assembly 56 may be removed from both anchoring and sealing engagement with the tubular body 54, and the operating tool 12 sealed to the mandrel seating surface 52 by one or more seal assemblies 140, whereby the packer central passage 50 may be opened for fluid flow therethrough along the flow path 150 through the operating tool 12. In practice, the operating tool 12 may form the continuation of an operating string, or pipe string, connected at the top of the tool by threaded connection to the box 148, for example, with the flow path 150 continuing upwardly through the interior of the operating string.

In FIG. 3, the packer 10 is illustrated, in fragment, set within a well conduit 39. The packer 10 may be positioned within such a well conduit 39 by means of lowering the packer within the conduit on a tubing string in the well known manner. The packer 10 is then set, either hydraulically or mechanically as noted. Thus, the slip members 16 and 18 are manipulated into gripping engagement with the interior surface of the well conduit 39, and the packer seal assembly 14 is axially compressed to radially expand the resilient seal members 15 thereof into sealing engagement with the well conduit. Then, the tubular body 54, continuing upwardly along the packer by means of the collar 40 and packer mandrel 24, is both anchored and sealed to the well conduit 39. The pipe string (not shown) used to so position and set the packer 10 may be retained in place, or disengaged from the set packer and removed from the well as appropriate.

With the packer 10 set within the well conduit 39, the valve assembly 56 anchored and sealed to the tubular body as in FIGS. 1B and 3 provides at least partial closure of the central passage 50 against fluid flow therethrough, at least in the upward longitudinal sense, by means of the valve device 118. Consequently, the well conduit 170 remains closed against upward fluid flow, while, with appropriate hydraulic pressure, for example, fluid may be forced downwardly through the valve mechanism 118. Thus, the packer 10 may be utilized in squeeze cementing operations, or in formation testing procedures, for example. Further, the valve assembly 56 serves as a downhole safety valve against well blowouts, for example. Other uses for such a packer with a downhole valve assembly will be appreciated in view of the present disclosure.

The operating tool 12 may be manuvered down through the interior of the well conduit 39 by means of an operating string, for example. The operating tool 12 may be lowered until the transfer tool 156 passes through the packer mandrel 24 and extends into the interior of the valve assembly 56 as illustrated in FIG. 3. The transfer tool surfaces 168 and 170 are received within the second sleeve member 60, with the lower surface region 170 engaging the second dogs 82 and maintaining them in the first sleeve member groove 96. The transfer tool 156 may be further lowered relative to the second sleeve member until the frustoconical surface 174 engages the generally complementary frustoconical sleeve member surface 133. Then, the transfer tool profile 172 is in registration with the second anchoring dogs 82, which may then retract out of the sleeve groove 96 and into the transfer tool profile 172.

As the transfer tool surface 170 is lowered past the level of the second anchoring dogs 82, the surface 170 engages the first latch member camming surface **100*b*, and forces the latch member 100 to rotate counterclockwise as viewed in FIG. 3, withdrawing the latching edge 100*a* from the first sleeve member groove 98**.

Thus, in the configuration shown in FIG. 3, the transfer tool has unlatched the second sleeve member 60 from the first sleeve member 58, and has engaged the frustoconical surface 170 with the complementary surface 133 of the second sleeve. The second sleeve member 60 remains in the first longitudinal position as shown, hanging by the second dogs 82 engaging the grooves 96 and/or 172, since the dogs are too large radially to pass between the sleeve surface 97 and the transfer tool surface 170.

In the configuration of FIG. 3, the packer central passage 50 is still closed by means of the valve mechanism 118, with the valve assembly 56 still sealed to the tubular body 54. Also, the operating tool 12 is sealed to the packer mandrel 24 by one or more of the seal assemblies 140, with the resilient seal members 142 under sufficient axial compression as described hereinbefore to be radially outwardly expanded into sealing engagement with the annular surface 52 of the packer mandrel 24. The operating tool ports 154 are automatically positioned below the sealing engagement between the packer mandrel 24 and the seal assemblies 142.

The operating tool 12 may be manipulated to completely disengage the sleeve assembly 56 from the packer 10 by further downward movement of the operating tool. In FIG. 4, the transfer tool 156 has been lowered to propel the second sleeve member 60, by the abutting engagement of the surfaces 133 and 174, to move longitudinally relative to the first sleeve member 58 from the first position (FIG. 3) to the second position in which the reduced outer diameter annular surface region 92 is in registration with the first anchoring dogs 74. To achieve the second position as illustrated in FIG. 4, the second anchoring dogs 82 are forced out of the first sleeve member annular groove 96, and into the transfer tool profile 172, as the dogs 82 are lowered with the second sleeve member 60, and ride along the reduced inner diameter interior surface 97 of the first sleeve member 60. Then, the sleeve surface 97 maintains the second anchoring dogs 82 within the transfer tool profile 172, thus anchoring the second sleeve member 60 to the transfer tool 156.

With the larger outer diameter annular sleeve surface 90 removed from behind the first anchoring dogs 74, the dogs 74 may move out of the tubular body groove 88 against the smaller outer diameter surface 92 of the second sleeve member 60, to permit the first sleeve member 58 to move longitudinally relative to the tubular body 54 with the transfer tool 156. However, until the transfer tool 156 is further lowered, the first sleeve member 58 remains generally in the position illustrated in FIG. 4, held by the anchoring dogs 74 engaging the transfer tool surface 94 and/or the tubular body groove 88, since the dogs 174 are too large radially to pass between the surfaces 68 and 90.

As the second sleeve member 60 is moved to the second longitudinal position relative to the first sleeve member 58 as illustrated in FIG. 4, the sleeve slot 61 is lowered relative to the sleeve pin 62. Also, the latch member 100 carried by the second sleeve member 60 is lowered out of registration with the first sleeve member annular groove 98, and the second sleeve member external annular groove 108 is positioned in registration with the latch member 110 carried by the first sleeve member.

In the configuration of FIG. 4, the valve assembly 56 is still sealed to the tubular body 54 by the seal members 62 and the sealing surfaces at 70.

Figure 5A:
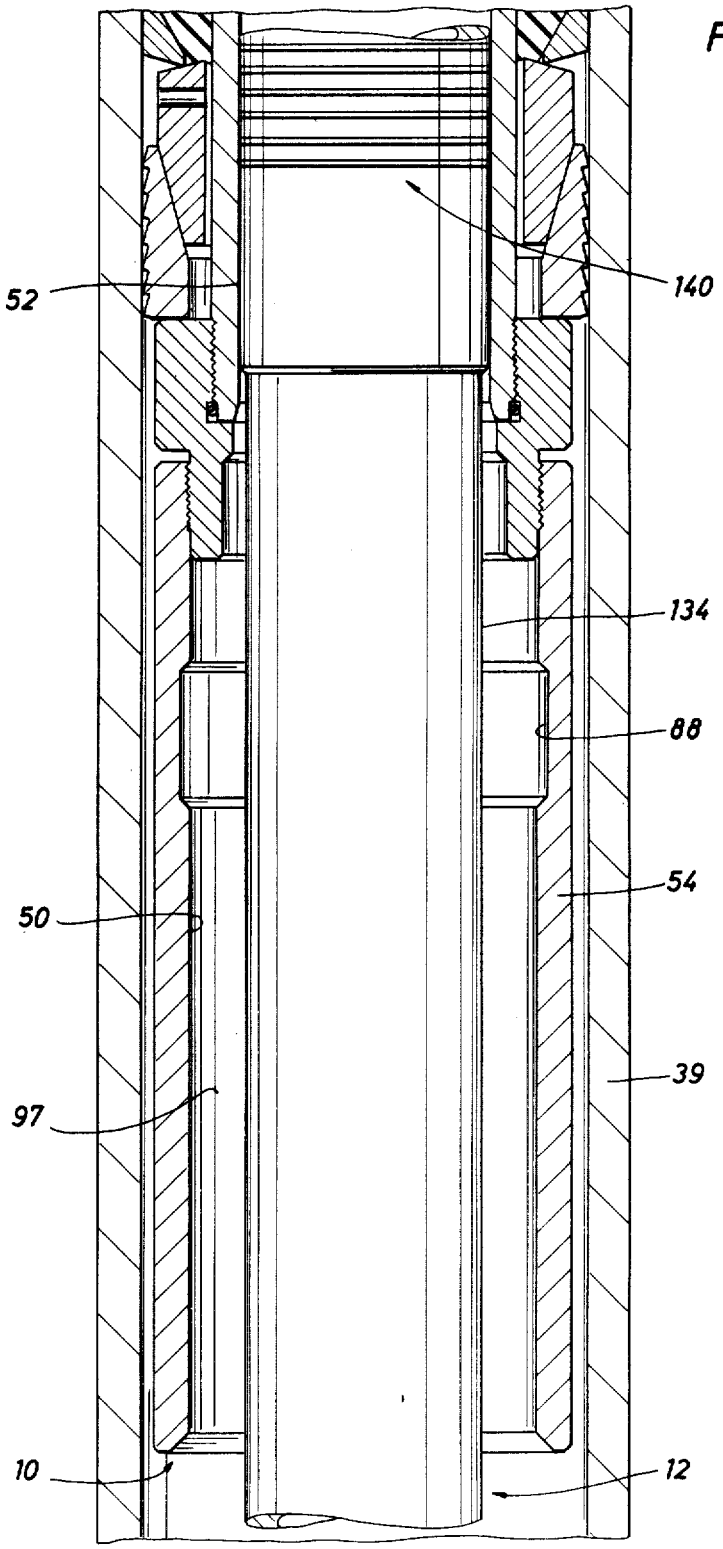

FIGS. 5A and 5B illustrate the valve assembly 56 completely supported by the transfer tool 156, and completely disengaged from the tubular body 54 by the operating tool 12 having been lowered relative to the set packer 10. The operating tool 12 may be of any desired length, with a sufficient number, and axial distribution density, of seal assemblies 140 to ensure that the operating tool remains sealed to the packer mandrel 24 with the valve assembly 56 thus lowered out of the tubular body 54 regardless of the depth at which the valve assembly may be repositioned. The locator shoulder 146 (FIG. 2A) may be utilized to limit the downward movement of the operating tool 12 relative to the set packer 10. For example, the locator shoulder 146 may be received by the generally complementary frustoconical interior surface 45 of the packer 10, positioned above the seating surface 52 (FIG. 1A), leaving the valve assembly 56 suspended below the tubular body 24, but with the operating tool 12 still sealed to the packer 10 by one or more seal assemblies 140 engaging the mandrel surface 52 (FIGS. 5A and 5B).

In the configuration of FIGS. 5A and 5B, with the operating tool 12 sealed to the set packer 10, the ports 154 are open to fluid flow along the interior of the well conduit 39. Thus, fluid within the well conduit 39 may flow along the flow path 150 within the operating tool 12 and between that passage and the region exterior to the packer 10, within the conduit 39 and below the set packer. Such repositioning of the valve assembly 56 below the set packer 10 consequently opens the central passage 50 within the packer to fluid flow, but along the flow path 150 within the operating tool 12.

As the transfer tool 156 moves the valve assembly 56 downwardly out of the configuration within the tubular body 54 illustrated in FIG. 4, the downward force applied by the transfer tool 156 to the second sleeve member 60 by means of the abutting engagement between the frustoconical surface 174 and the generally complementary surface 133 may be transmitted to the first sleeve member 58 by means of the upper limit of the sleeve member slot 61 engaging the pin 62. Thus, as the transfer tool 156 drives the second sleeve member 60 downwardly, the first sleeve member 58 is also propelled downwardly by means of the pin 120. The first latching dogs 74 are lowered with the first sleeve member 58 and are moved out of the tubular body groove 88 against the second sleeve member surface 92. The first sleeve member 58 is prevented from moving downwardly relative to the second sleeve member 60 by the first dogs 74 being held by the tubular body surface 97 against the sleeve surfaces 92 and/or 94.

As the two sleeve members 58 and 60 are lowered relative to the tubular body 54, the metal-to-metal seal at 70 is disengaged, followed by the resilient seal members 63 sliding out of sealing engagement with the interior surface 68 of the tubular body. The camming surface **110*b* of the second latching member 110 is ultimately disengaged from the interior surface 68 of the tubular body 54, allowing the spring 116 to rotate the latch member to drive the latching edge 110*a* into the second sleeve member groove 108 (FIG. 5B). Then, the first sleeve member 58 is locked against further downward longitudinal movement relative to the second sleeve member 60 by means of the latching edge 110*a* engaging the shoulder 109. At the same time, the second sleeve member 60 is in the second longitudinal position relative to the first sleeve member 58, with the interior surface 97 of the first sleeve member maintaining the second anchoring dogs 82 fixed within the transfer tool profile 172. The first sleeve member 58 hangs on the second sleeve member 60 by means of the second latch member 110, and the second sleeve member is locked to the transfer tool 156 by means of the second anchoring dogs 82. Thus, the valve assembly 56 has been completely disengaged from the tubular body 54, and is completely supported by the transfer tool 156 as shown in FIG. 5B**.

It will be appreciated that further operations within the well containing the conduit 39 may be carried out with the valve assembly 56 supported by the operating tool 12 as illustrated in FIGS. 5A and 5B. Consequently, fluid flow may be permitted along the interior of the well conduit 39 without removing the operating tool 12, the valve assembly 56, or the operating string (not shown) by which the operating tool has been maneuvered.

When it is appropriate to close off the well conduit 39 against fluid flow, at least in the upward longitudinal sense, the valve assembly 56 may be repositioned within the tubular body 54, and anchored and sealed relative to the packer 10. To effect such reengagement of the valve assembly 56 with the packer 10, the operating tool 12 is merely raised, generally reversing the operation of removing the valve assembly from engagement with the packer as described hereinbefore.

When the operating tool 12 is raised from the configuration shown in FIGS. 5A and 5B, the valve assembly 56 is raised on the transfer tool 156 with the sleeve members 58 and 60 in the second position as illustrated in FIG. 5B. The first sleeve member 58 is drawn upwardly within the tubular body 54, with the tubular body surface 68 maintaining the first dogs 74 against the sleeve surfaces 92 and/or 94. Ultimately, the camming surface **110*b* engages the interior surface 68 of the tubular body. The second latch member 110 is then rotated clockwise as viewed in FIG. 4 to remove the latching edge 110*a* from the second sleeve member annular groove 108. However, the first anchoring dogs 74, maintained within the profile of the annular surface 92 by the surface 68, prevent the first sleeve member 58 from moving downwardly relative to the second sleeve member 60. The first and second sleeve members 58 and 60, respectively, continue to move as a unit, with the first sleeve member holding the second anchoring dogs 82 in anchoring engagement within the transfer tool profile 172, and the tubular body interior surface 68 holding the first anchoring dogs 74 in anchoring engagement within the profile of the sleeve surface 92. Consequently, upward movement of the transfer tool 156 is accompanied by upward movement of both sleeve members 58 and 60** in the second longitudinal position.

With the operating tool 12 thus raising the valve assembly 56 within the tubular body 54, the resilient seal members 63 ultimately slide into sealing engagement with the interior surface 68 of the tubular body, and the metal-to-metal seal 70 is subsequently engaged as well. These sealing engagements between the first sleeve member 58 and the tubular body 54 are completed by the time the valve assembly 56 has been raised to place the first anchoring dogs 74 in registration with the tubular body groove 88. Then, the anchoring dogs 74 are free to move radially outwardly to be received by the groove 88, and permit upward longitudinal movement of the second sleeve member 60 relative to the first sleeve member and out of the first position, with the annular sleeve surface 90 engaging and maintaining the anchoring dogs 74 in the extended configuration in the groove 88, as the sealing engagement at 70 limits the upward movement of the first sleeve member relative to the tubular body 54. The second sleeve member, being still anchored to the transfer tool by the second anchoring dogs 82 held within the transfer tool profile 172 by the sleeve surface 97, is raised with the transfer tool 156, as the first sleeve member 60 is anchored to the tubular body by means of the first anchoring dogs 74 being locked in engagement with the groove 88 by means of the sleeve surface 90 moving in registration with the dogs 74 (FIG. 3).

As the operating tool 12 is raised, the second sleeve member 60 continues upwardly with the transfer tool 156 until the first position is achieved, with the second anchoring dogs 82 in registration with the first sleeve member groove 96 (FIG. 3). At that point, the second sleeve member slot 61 has been raised to engage the lower extent of that slot with the pin 62, preventing further upward movement of the second sleeve member 60 relative to the first sleeve member 58. Also, the latch member 100 has been placed in registration with the sleeve groove 98. Then, as the transfer tool 156 is further raised, the second anchoring dogs 82 are forced radially outwardly by the transfer tool annular surface 170, and received within the fist sleeve member groove 96. The transfer tool surface 170 maintains the second sleeve member 60 anchored relative to the first sleeve member by holding the second anchoring dogs 82 within the annular groove 96. This anchoring engagement by means of the second dogs 82 is maintained until after the transfer tool surface 170 is raised out of registration with the dogs 82. Before that occurs, however, the surface 170 disengages from the camming surface 100*b* of the first latch member 100, allowing this latch member to be propelled rotationally clockwise as viewed in FIGS. 1B, 3 and 4 to enter the sleeve groove 93 and engage the latching edge 100*a* with the groove shoulder 99. After the latch member 100 has engaged the annular groove 98, the transfer tool 156 may be moved upwardly beyond the location of the second anchoring dogs 82.

The first latch member 100 maintains the second sleeve member 60 against longitudinal movement downwardly relative to the first sleeve member 58. The second sleeve member 60 is locked in the configuration shown in FIG. 1B, with the annular surface 90 in registration with the first anchoring dogs 74, maintaining the first sleeve member anchored relative to the tubular body 54. Consequently, the valve assembly 56 is both anchored and sealed to the tubular body 54 and, therefore, the set packer 10. The valve mechanism 118 blocks the passage 50 against upward fluid flow, but permits downward fluid flow with sufficient pressure to compress the spring 128 and lower the valve element 124 relative to the seating surface 122.

The operating tool 12 may be maintained extending within the set packer 10, and sealed thereto by means of one or more seal assemblies 142, with the valve assembly 56 both anchored and sealed to the tubular body 54. Fluid flow through the packer 10 occurs along the flow path 150 within the operating tool 12. Alternatively, the operating tool 12 may be removed completely from the packer 10 and even from the well, leaving the valve assembly 56 supported by the packer 10 as in FIGS. 1A and 1B.

During the raising of the operating tool 12, such as when the valve assembly 56 is being returned to the packer 10 by the transfer tool 156, if the upward progress of the transfer tool is impeded, the shear screws 166 may be broken to free the upper portion of the operating tool for withdrawal from the well. Thus, if debris, for example, clogs or blocks the tubular body 24 or the valve assembly 56 with the transfer tool 12 attached to the valve assembly, the operating string used to manipulate the well may still be removed, allowing the well to be cleared by drilling the blockage, for example.

The present invention provides a well tool for selectively closing off, at least partly, a well conduit against fluid flow at least in one longitudinal direction. Further, the closure mechanism may be disengaged to permit fluid flow through the conduit without the closure mechanism being removed from the conduit. In particular, the present invention in the form of a well packer and valve mechanism may be positioned within a well conduit, and selectively operated by an operating tool, including a transfer tool, whereby the valve mechanism may be disengaged from both anchoring and sealing engagement with the packer, and engaged with the transfer tool for repositioning within the well conduit. Further, by manipulation of the operating tool, the valve assembly may be removed from the transfer tool and reengaged in both anchoring and sealing engagement with the packer. Additionally, the valve mechanism is thus manipulated by straight, longitudinal movement of the operating tool. Consequently, the well could be relatively rapidly closed against upward fluid flow, providing a distinct safety advantage where conditions threaten a blow out.

The foregoing disclosure and description of the invention is illustrative and explanatory thereof, and various changes in the method steps as well as in the details of the illustrated apparatus may be made within the scope of the appended claims without departing from the spirit of the invention.

We claim:

1. Apparatus comprising:

a. tubular body means, including first internal annular groove means;

b. first sleeve means for positioning generally within said tubular body means;

c. second sleeve means for positioning generally within said first sleeve means wherein said second sleeve means is selectively movable between a first longitudinal position relative to said first sleeve means and a second longitudinal position relative to said first sleeve means;

d. first anchor means mounted on said first sleeve means and selectively radially movable between an extended configuration, wherein said first anchor means may be received in said first groove means, and a retracted configuration, wherein said first anchor means may be withdrawn from said first groove means;

e. said second sleeve means including first surface means which is in registration with said first anchor means when said second sleeve means is in said first position, whereby said first surface means maintains said first anchor means in said extended configuration, and second surface means of lesser outer extent than said first surface means and which is in registration with said first anchor means when said second sleeve means is in said second position, whereby said first anchor means may move to said retracted configuration;

f. first latch means operable when said second sleeve means is in said first position relative to said first sleeve means for preventing movement of said second sleeve means out of said first position;

g. second latch means operable when said second sleeve mens is in said second position relative to said first sleeve means for maintaining said second sleeve means in said second position;

h. whereby said first and second sleeve means may be releasably held against longitudinal movement relative to said tubular body means with said first sleeve means positioned within said tubular body means, and said second sleeve means in said first position relative to said first sleeve means, such that said first surface means maintains said first anchor means in said extended configuration within said first groove means and said first latch means maintains said second sleeve means releasably fixed against longitudinal movement relative to said first sleeve means; and i. transfer means for selectively disengaging said first latch means and moving said second sleeve means from said first position to said second position relative to said first sleeve means.

2. Apparatus as defined in claim 1 wherein:

a. said first sleeve means includes second internal annular groove means;

b. said transfer means includes external annular groove means which may be aligned with said second groove means when said second sleeve means is in said first position relative to said first sleeve means;

c. said second sleeve means carries second anchor means selectively radially movable between an extended configuration wherein, with said second sleeve means in said first position, said second anchor means may be received in said second groove means, and a retracted configuration wherein, with said transfer means positioned within said second sleeve means, said second anchor means may be received in said external annular groove means;

d. said first sleeve means includes internal surface means for engaging said second anchor means with said second sleeve means in said second position, and maintaining said second anchor means in said retracted configuration within said external annular groove means to maintain said second sleeve means anchored to said transfer means; and e. said transfer means includes external surface means axially displaced from said external annular groove means for engaging said second anchor means and maintaining said second anchor means in said extended configuration within said second internal annular groove means to maintain said second sleeve means in said first position fixed against longitudinal movement relative to said first sleeve means.

3. Apparatus as defined in claim 2 further comprising seal members carried by said first sleeve means and by said tubular body means, mutually engagable for sealing said first sleeve means to said tubular body means when said first sleeve means is positioned relative to said tubular body means so that said first anchor means may be received in said first internal annular groove means.

4. Apparatus as defined in claim 3 further comprising valve means carried by said first sleeve means whereby the interior of said first sleeve means may be closed to movement of material in at least one longitudinal sense relative to said first sleeve means.

5. Apparatus as defined in claim 4 further comprising seal means for sealing said tubular body means to a conduit circumscribing said tubular body means.

6. Apparatus as defined in claim 4 or, in the alternative, as defined in claim 3 further comprising means for establishing a flow path through said tubular body means when said transfer means has so moved said first and second sleeve means relative to said tubular body means whereby said first sleeve means is not sealed to said tubular body means.

7. Apparatus comprising:

a. tubular body means, including first internal annular groove means;

b. first sleeve means for positioning generally within said tubular body means;

c. second sleeve means for positioning generally within said first sleeve means wherein said second sleeve means is selectively movable between a first longitudinal position relative to said first sleeve means and a second longitudinal position relative to said first sleeve means;

d. first anchor means mounted on said first sleeve means and selectively radially movable between an extended configuration, wherein said first anchor means may be received in said first groove means, and a retracted configuration, wherein said first anchor means may be withdrawn from said first groove means;

e. said second sleeve means including first surface means which is in registration with said first anchor means when said second sleeve means is in said first position, whereby said first surface means maintains said first anchor means in said extended configuration, and second surface means of lesser outer extent that said first surface means and which is in registration with said first anchor means when said second sleeve means is in said second position, whereby said first anchor means may move to said retracted configuration;

f. first latch means operable when said second sleeve means is in said first position relative to said first sleeve means for preventing movement of said second sleeve means out of said first position;

g. second latch means operable when said second sleeve means is in said second position relative to said first sleeve means for maintaining said second sleeve means in said second position;

h. whereby said first and second sleeve means may be releasably held against longitudinal movement relative to said tubular body means, and said second sleeve means in said first position relative to said first sleeve means, such that said first surface means maintains said first anchor means in said extended configuration within said first groove means and said first latch means maintains said second sleeve means releasably fixed against longitudinal movement relative to said first sleeve means; and i. wherein said first and second latch means comprise spring-biased latch members.

8. Apparatus for selectively opening and closing a flow passage comprising:

a. closure means mounted on a sleeve assembly for at least partial closure of said flow passage;

b. receptacle means, fixed relative to said flow passage, for receiving in anchoring and sealing engagement said sleeve assembly;

c. operating means for engagement with said sleeve assembly whereby, upon longitudinal movement of said operating means in one longitudinal sense relative to said receptacle means, said sleeve assembly may be engaged with said operating means and disengaged from anchoring and sealing engagement with said receptacle means, and moved longitudinally relative thereto to selectively open said flow passage through said receptacle means, and whereby, upon longitudinal movement of said operating means in the opposite longitudinal sense relative to said receptacle means, said sleeve assembly may be placed in anchoring and sealing engagement with said receptacle means to at least partially close said flow passage, and disengage from said operating means; and wherein said closure means comprises check valve means.

9. Apparatus comprising:

a. a generally tubular body with an internal passage;

b. a sleeve assembly;

c. anchoring means mounted on said sleeve assembly and selectively operable for cooperation with said tubular body for releasably connecting said sleeve assembly to said tubular body;

d. said sleeve assembly including a first member and a second member movable relative to said first member for so selectively operating said anchoring means;

seal means for sealing said sleeve assembly to said tubular body when said sleeve assembly is so releasably connected to said tubular body;

closure means carried by said sleeve assembly for at least partially closing said tubular body passage when said sleeve assembly is so releasably connected to said tubular body; and wherein said closure means comprises biased check valve means.

10. Apparatus comprising:

a. a generally tubular body with an internal passage;

b. a sleeve assembly;

c. anchoring means mounted on said sleeve assembly and selectively operable for cooperation with said tubular body for releasably connecting said sleeve assembly to said tubular body;

d. said sleeve assembly including a first member and a second member movable relative to said first member for so selectively operating said anchoring means;

operating tool means for selectively moving said second member relative to said first member to so operate said anchoring means; and wherein said operating means is sealed to said tubular body when said operating means has effected disengagement of said sleeve assembly from said tubular body.

11. A valve for use in a well comprising:

a. a generally tubular body with a central passage for positioning within a well, and including internal annular groove means;

b. a sleeve assembly, receivable within said tubular body central passage, and including anchoring means radially movable between a retracted configuration, whereby said sleeve assembly may be moved longitudinally within said tubular body central passage, and an extended configuration wherein said anchoring means may be received within said tubular body groove means for releasably anchoring said sleeve assembly relative to said tubular body;

c. said sleeve assembly further comprising a first sleeve member carrying said anchoring means for radial movement relative thereto, and a second sleeve member longitudinally movable within said first sleeve member between a first position and a second position, said second sleeve member including first surface means for engaging said anchoring means and maintaining said anchoring means in said extended configuration with said second sleeve member in said first position, and second surface means, axially spaced from said first surface means and of lesser outer extent, whereby said anchoring means may move to said retracted configuration when said second surface means is in registration therewith with said second sleeve member in said second position;

d. closure means, as part of said sleeve assembly, for at least partially preventing fluid flow through said central passage when said sleeve assembly is so releasably anchored to said tubular body;

e. operating means, for selectively operating said sleeve assembly for engagement with, and disengagement from, said tubular body whereby fluid flow through said central passage may be generally selectively controlled, including transfer means for engaging said sleeve assembly and selectively manipulating said second sleeve member relative to said first sleeve member;

f. tubular means as part of said operating means, including a flow path, and whereby said transfer means may be so manipulated;

g. seal means whereby said tubular means may be sealed to said tubular body when said transfer means has so disengaged said sleeve assembly from said tubular body; and h. whereby said tubular means may be so manipulated to effect disengagement of said sleeve assembly from said tubular body to permit fluid flow through said tubular body central passage by means of said flow path, and may be manipulated to engage said sleeve assembly with said tubular body to effect at least partial closure of said tubular body central passage to fluid flow therethrough.

12. A valve as defined in claim 11 wherein said seal means comprises resilient, annular seal members carried by said tubular means and an internal annular seating surface, connected to said tubular body, such that said seal members may sealingly engage said seating surface when said operating means has so manipulated said sleeve assembly out of engagement with said tubular body, and said flow path includes passage means for communicating between said tubular body central passage and said flow path such that, when said sleeve assembly has been so manipulated out of engagement with said tubular body fluid is permitted to flow between said tubular body central passage and said flow path.

13. A valve as defined in claim 12 wherein said closure means comprises seal elements carried by said sleeve assembly and by said tubular body such that, when said sleeve assembly is so releasably connected to said tubular body, said seal elements provide sealing engagement between said tubular body and said sleeve assembly, and check valve means carried by said sleeve assembly whereby said tubular body central passage may be closed to fluid flow in at least one direction.

14. A valve as defined in claim 13 wherein:

a. said sleeve assembly further comprises second anchoring means, carried by said second sleeve member and radially movable between an extended configuration and a retracted configuration, and second internal annular groove means as part of said first sleeve member for receiving said second anchoring means in said extended configuration when said second sleeve member is in said first position;

b. said transfer means includes external annular groove means;

c. said second anchoring means may be received by said transfer means annular groove means when said transfer means is in position to so manipulate said sleeve assembly; and d. whereby, with said transfer means positioned to so manipulate said sleeve assembly, said sleeve assembly may be anchored to said transfer means by said second anchoring means held in said transfer means groove means by said first sleeve member.

15. A valve as defined in claim 11 wherein:

a. said sleeve assembly further comprises second anchoring means, carried by said second sleeve member and radially movable between an extended configuration and a retracted configuration, and second internal annular groove means as part of said first sleeve member for receiving said second anchoring means in said extended configuration when said second sleeve member is in said first position;

b. said transfer means includes external annular groove means;

c. said second anchoring means may be received by said transfer means annular groove means when said transfer means is in position to so manipulate said sleeve assembly; and d. whereby, with said transfer means positioned to so manipulate said sleeve assembly, said sleeve assembly may be anchored to said transfer means by said second anchoring means held in said transfer means groove means by said first sleeve member.

16. A valve for use in a well comprising:

a. a generally tubular body with a central passage for positioning within a well, and including internal annular groove means;

b. a sleeve assembly, receivable within said tubular body central passage, and including anchoring means radially movable between a retracted configuration, whereby said sleeve assembly may be moved longitudinally within said tubular body central passage, and an extended configuration wherein said anchoring means may be received within said tubular body groove means for releasably anchoring said sleeve assembly relative to said tubular body;

c. said sleeve assembly further comprising a first sleeve member carrying said anchoring means for radial movement relative thereto, and a second sleeve member longitudinally movable within said first sleeve member between a first position and a second position, said second sleeve member including first surface means for engaging said anchoring means and maintaining said anchoring means in said extended configuration with said second sleeve member in said first position, and second surface means, axially spaced from said first surface means and of lesser outer extent, whereby said anchoring means may move to said retracted configuration when said second surface means is in registration therewith with said second sleeve member in said second position;

d. closure means, as part of said sleeve assembly, for at least partially preventing fluid flow through said central passage when said sleeve assembly is so releasably anchored to said tubular body; and wherein said closure means comprises seal elements carried by said sleeve assembly and by said tubular body such that, when said sleeve assembly is so releasably connected to said tubular body, said seal elements provide sealing engagement between said tubular body and said sleeve assembly, and check valve means carried by said sleeve assembly whereby said tubular body central passage may be closed to fluid flow in at least one direction.

17. Apparatus for operating in a well comprising:

a. a packer, including a central passage circumscribed by an internal sealing element, and for anchoring and sealing to a well conduit;

b. a valve assembly releasably connectible to said packer such that, with said valve assembly so connected to said packer, said central passage is at least partially closed to fluid flow in one longitudinal sense;

c. operating means, for positioning within said packer and for engaging said valve means, whereby said valve means may be releasably connected to said operating means, and completely disengaged from said packer with said operating means sealingly engaging said seal element of said packer, and including flow passage means whereby, with said valve assembly so disengaged from said packer, fluid may flow within said central passage of said packer within said flow passage; and d. wherein said operating means may be manipulated to engage said valve assembly with said packer to so close said packer central passage, and said valve assembly may be disengaged from said operating means.

18. Apparatus for operating in a well, comprising:

a. a packer, including a central passage circumscribed by an internal sealing element, and for anchoring and sealing to a well conduit;

b. a valve assembly releasably connectible to said packer such that, with said valve assembly so connected to said packer, said central passage is closed to fluid flow in one longitudinal sense and open to fluid flow in the opposite longitudinal sense;

c. operating means, for positioning within said packer and for engaging said valve means, whereby said valve means may be releasably connected to said operating means, and completely disengaged from said packer with said operating means sealingly engaging said seal element of said packer, and including flow passage means whereby, with said valve assembly so disengaged from said packer, fluid may flow within said central passage of said packer within said flow passage; and d. wherein said operating means may be manipulated to engage said valve assembly with said packer to so close said packer central passage, and said valve assembly may be disengaged from said operating means.

19. A method of operating on a well comprising the following steps:

a. providing a packer set in such a well, and including a valve releasably attached to said packer for closing the central passage through said packer against at least fluid flow in one longitudinal sense; and b. manipulating an operating tool, including a transfer tool and a seal assembly, to connect the valve to the operating tool while completely disconnecting the valve from the packer, and sealing the operating tool to the packer, thereby opening a flow path through the operating tool and the packer;

c. manipulating the operating tool to connect the valve to the packer and disconnect the valve from the operating tool to so close the passage through the packer.

* * * * *